US005788232A

United States Patent [19]

Binkley

[11] Patent Number: 5,788,232

[45] Date of Patent: Aug. 4, 1998

[54] SPINABLE PUZZLE USING MAGNETIC WHEELS

[76] Inventor: Dennis E. Binkley, 1546 NW. Woodbine Way, Seattle, Wash. 98177

[21] Appl. No.: 787,150

[22] Filed: Jan. 22, 1997

[51] Int. Cl.[6] ..... A63F 9/08

[52] U.S. Cl. ..... 273/155; 273/153.5

[58] Field of Search ..... 273/153 R, 155, 273/153.5, 157 R

[56] References Cited

U.S. PATENT DOCUMENTS

| | | | |
|---|---|---|---|
| 2,554,942 | 5/1951 | Dobrowsky | 273/155 |
| 2,935,814 | 5/1960 | Freeze | 273/155 |
| 3,717,942 | 2/1973 | Presby | 273/155 |
| 4,114,877 | 9/1978 | Goldfarb et al. | 273/157 R |
| 4,552,361 | 11/1985 | Lafleur | 273/157 R |
| 4,865,324 | 9/1989 | Nesis | 273/155 |
| 5,083,788 | 1/1992 | Conotter | 273/155 |

FOREIGN PATENT DOCUMENTS

| | | | |
|---|---|---|---|
| 724131 | 2/1955 | United Kingdom | 273/155 |

*Primary Examiner*—Steven R. Wong
*Attorney, Agent, or Firm*—Jensen & Puntigam, P.S.

[57] ABSTRACT

A plurality of magnetic spin elements (wheels) having two opposing surfaces and a peripheral edge surface therebetween, wherein the spin elements are magnetized so that one surface of one spin element is attracted to the other surface of an adjacent element. A visual representation, such as an object, a person, a geographical scene or animals, is secured in the form of strip portions to the peripheral edge surfaces of the spin elements, such that when the spin elements are arranged in proper linear order and positioned correctly rotationally, the aligned visual representation appears. A plurality of spin elements can also be positioned on a spindle which has a mounting portion and a lower end portion arranged to maintain the spin elements on the spindle in one position and permit the spin elements to be removed in another position.

7 Claims, 3 Drawing Sheets

FIG. 1
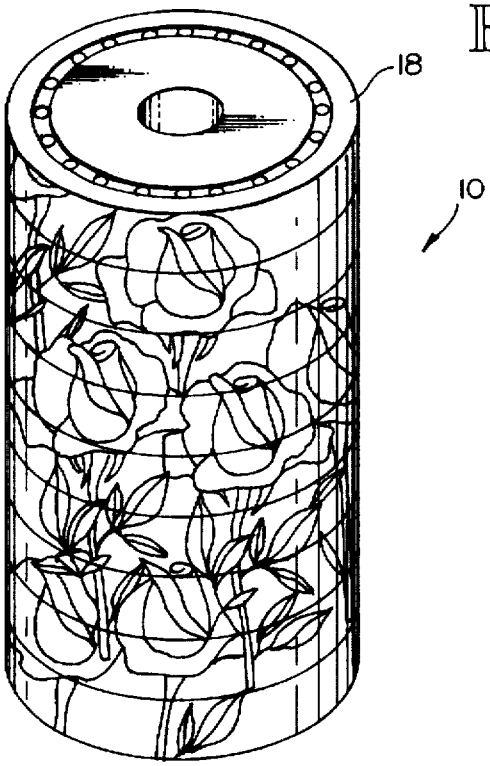
FIG. 3
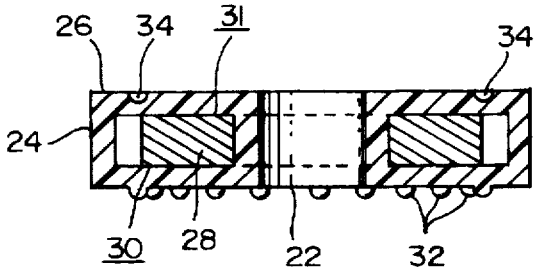
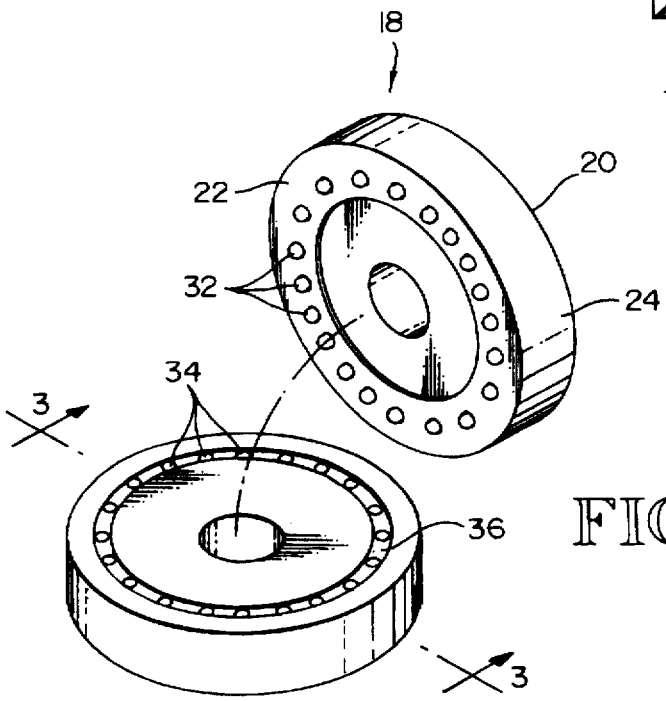
FIG. 2

SPINABLE PUZZLE USING MAGNETIC WHEELS

TECHNICAL FIELD

This invention relates generally to puzzles which include a specific visual representation of an object, a scene or of people, for example, and more particularly concerns such a puzzle which is positioned on a series of magnetic elements which may be rotated and repositioned relative to each other.

BACKGROUND OF THE INVENTION

Two-dimensional (flat) puzzles which feature a visual representation, i.e. a picture of some kind, are of course well known. Typically, such puzzles are made up of two-dimensional, flat and thin planar pieces having a small portion of the complete visual representation of the puzzle on one surface thereof. The puzzle pieces, when fitted together properly, display the visual representation in a unitary form. Typically, the entire surface of the completed puzzle is occupied by the visual representation. The level of difficulty of completing a puzzle can vary enormously, with certain puzzles presenting a challenge to even the most sophisticated and skilled user. This is done by varying the number and size of the pieces and the particular visual representation.

While such puzzles have been enormously popular for centuries, they do have some inherent disadvantages. In the typical flat puzzle, the individual pieces can be easily lost, and a large flat area must be set aside for working on the puzzle. Further, it is difficult to transport the puzzle while it is being worked on, as the various pieces must be maintained in a particular orientation, often with large gaps between the positioned puzzle elements, particularly at the beginning of working on the puzzle.

Another well-known type of puzzle involves interlocked elements which may be rotated or otherwise moved relative to the remaining pieces. The object of such puzzles typically is to line up a series of similar colors and/or numbers on the various faces of the individual elements. Such puzzles, while requiring manipulative and visual skills, do not have the consistent attraction, however, of the more conventional two-dimensional visual representation puzzle.

One embodiment of the interlocking manipulative puzzles involves a plurality of magnetic wheels which may be individually moved relative to each other along a linear line of orientation and/or rotated relative to each other. These magnetic "spin wheels" or elements are not connected physically to each other, other than by magnetic attraction, so that the individual elements may with only a little effort be repositioned relative to the other elements, i.e. in a new linear order or a new rotational position. The magnetic attraction is strong enough, however, that the elements readily stay together. Such an arrangement is shown in U.S. Pat. No. 4,865,324. The primary use to date of such an arrangement, however, includes the use of numbers and/or letters on the edge surfaces of the elements to produce mathematical and word games. Such math and word games, however, lack the attractiveness of the traditional two-dimensional visual representation puzzle.

SUMMARY OF THE INVENTION

Accordingly, the present invention is a spinable puzzle which comprises: a plurality of puzzle elements, each puzzle element having first and second opposing faces and a peripheral edge surface therebetween, wherein the puzzle elements are magnetized, such that a first face of one puzzle element is attracted to a second, opposing face of another puzzle element, said plurality of puzzle elements being thus readily alignable along a common linear axis, wherein each puzzle element is rotatable relative to every other puzzle element and is positionable along said linear axis relative to every other puzzle element; and a two-dimensional visual representation which is divided into successive strip portions and wherein said strip portions are, respectively, formed on the peripheral edge surfaces of the puzzle elements, wherein when the puzzle elements are in a correct linear order and a correct rotational position, the visual representation is presented around the circumference of the spin puzzle, covering substantially the entire peripheral surface area of the spinable puzzle.

BRIEF DESCRIPTION OF THE DRAWINGS

FIG. 1 shows a puzzle of the present invention featuring a flower garden for its visual representation.

FIG. 2 shows in more detail how two elements of the present spinable puzzle fit together.

FIG. 3 is a cross-section of a spinable puzzle element.

BEST MODE FOR CARRYING OUT THE INVENTION

Figure 4:
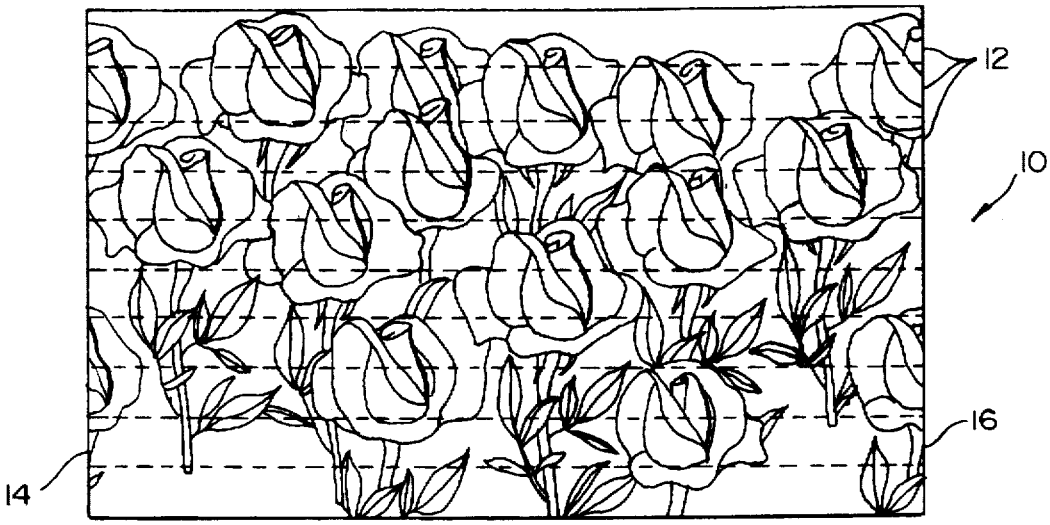
FIG. 4 shows the same visual representation as FIG. 1 in two dimensions, but with indications showing how it may be applied to the puzzle elements.

FIG. 4 shows generally at 10 a two-dimensional representation of a particular scene, in this case a portion of a simplified flower arrangement featuring roses. In a conventional flat puzzle, this two-dimensional representation would have been formed on a relatively stiff base layer, typically cardboard, and then segmented into a plurality of small pieces of various outlines. The individual pieces are supplied to the customer in a container, either loosely, or initially integrated, i.e. like the completed puzzle. In the latter case, the pieces are separated by the user. The user then attempts to put the puzzle together.

In the embodiment shown of the present invention, the visual representation is also segmented, but instead of being in the form of completely random pieces which are connectable by virtue of their interlocking edge portions, comprises a plurality of equal-sized strips, shown by dashed lines 12—12, extending from one side edge 14 of the visual representation 10 to the other side edge 16. Each strip 12 is substantially identical in size and shape. The representation or image on the strips is arranged to provide an "integrated" image, so that there is in effect no "beginning/end" line for the image. When the side edges are abutted, the image flows continuously, i.e. the image is seamless, without a beginning or end. This increases the difficulty of the puzzle of the present invention.

Although the number of strips comprising the puzzle image of the present invention may vary, typically the number of strips should be sufficient that each individual strip will show only a small portion of the visual representation, so that completion of the puzzle presents an appropriate challenge for the user.

Each of said strips 12 is positioned on the peripheral edge of a magnetic spin element 18, as shown for example in FIG.

1. The strips 12 are of a proper length, relative to the peripheral edge surface of the spin elements, that the strip extends around the entire peripheral edge. The respective end edges of a strip 12 thus abut each other when positioned on a spin element. This abutting of the edges of each strip makes possible a continuous, overlapping, integrated image in the rotational direction. This is shown in FIG. 1.

Figure 5:
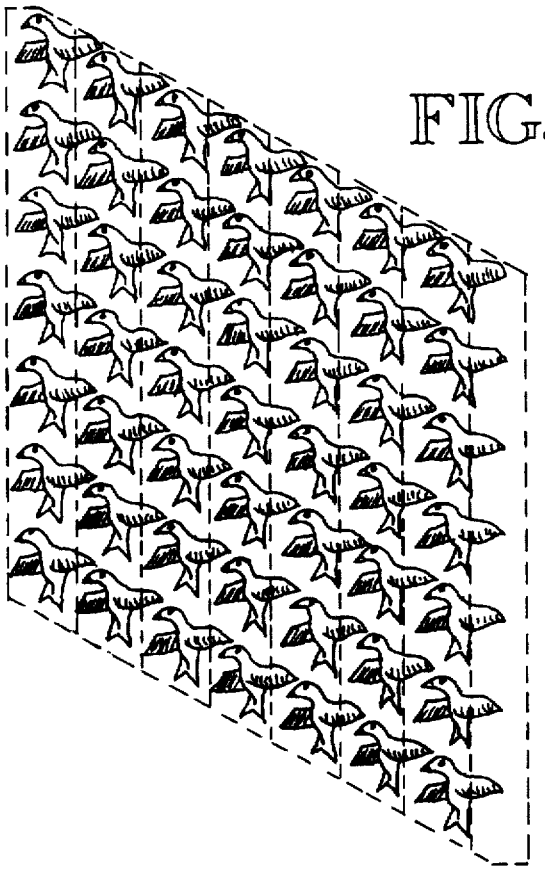
FIG. 5 shows another two-dimensional representation which is specifically designed so that the image appears to be continuous around the spinable puzzle.

FIG. 5 shows another puzzle embodiment, also arranged to give a "wrap-around", integrated, never-ending appearance to the puzzle. The individual strips indicated by the dotted lines will be on the horizontal. Such a puzzle arrangement also tends to obscure the proper dividing line between adjacent elements, making the puzzle more difficult to complete. In FIG. 5, because of the integrated, continuous, closely repeating pattern, determining the proper linear and rotational position of each spin element will not be easy.

The spin elements used in the present invention are fully described in U.S. Pat. No. 4,865,324; the contents of that patent relative to the puzzle elements described herein is hereby incorporated by reference.

Briefly, however, the individual spin elements 18 are generally disk-like, i.e. circular, in shape, with each spin element including first and second opposing flat surfaces 20 and 22, and an intermediate peripheral edge surface 24 therebetween. The spin elements will typically have a small (approximately ⅜ inch) central opening. A two-inch diameter disk, approximately ⅜-inch thick, works satisfactorily, but it should be understood that the disk could be of different diameters and thicknesses.

In the embodiment shown, each spin element 18 includes a hard plastic case portion 26 which encloses an interior magnetic ring 28. One surface 30 of the magnetic ring 28 will be of one magnetic polarity, while the opposing surface 31 of the ring is of the other polarity. On one of the flat surfaces of spin element 18 are a plurality of protuberances or nipples 32. The protuberances 32 are evenly spaced, in a circular pattern, about the axial center of the spin element. In the embodiment shown, the diameter of the circle of protuberances 32 is approximately 1½ inches.

On the opposing flat surface of each spin element is an equal number of cavities 34 which are adapted, sized and physically arranged to receive the protuberances 32 on an adjacent spin wheel. Adjacent spin elements are held together by magnetic interaction; each element may be individually rotated relative to the other spin element about their common central axis. The opposing surfaces of each spin element are furthermore configured so that adjacent elements abut each other, making for a substantially continuous peripheral surface over the length of the puzzle. To facilitate the rotation of each spin element, the cavities 34 on one surface of each spin element are located in a shallow groove 36, which provides a guide for the protuberances 32 on the adjacent spin element as one spin element is rotated relative to the others. Each successive cavity provides in effect a "stop" for the adjacent spin element as that element is rotated.

Hence, the arrangement and configuration of the spin elements provide an indexing-type movement capability as each element is rotated. In the embodiment shown, there are a total of 20 protuberances on one face of each spin element, and a matching number of cavities on the opposing face. It should be understood, however, that more or fewer protuberances and cavities could be used. It is advantageous, however, to use a fairly large number of protuberances, as this provides a large number of separate stops for the spin elements.

As indicated above, the peripheral surface 24 of each spin element will have one complete strip of the seamless puzzle image positioned thereon. When all of the spin elements in the puzzle are in proper linear order and have the proper rotational position, the desired visual representation will appear. The visual representation may vary. It could be objects of any kind, people, a geographic scene, animals, plants, or any other representation determined to be suitable for the structure of the puzzle elements. The properly aligned puzzle may be revolved as a unit to view the entire picture. Hence, the puzzle described herein presents two challenges to the user. First, the individual spin elements must be arranged in a correct linear order; second, the spin elements must be oriented correctly rotationally relative to each other. Such an arrangement provides an opportunity for substantial challenge to even the most skillful user, depending upon the particular visual representation.

In the embodiment shown, the puzzle has been described as being attached in some way to the peripheral surfaces of the spin elements; however, it should be understood that the puzzle could also be "applied" to the surfaces of the spin elements by embossing, engraving or by being painted or printed on those surfaces. Also, while the peripheral edge in the embodiment shown is circular, other geometric configurations could be used; the peripheral surface could be multifaceted as well. Further, the embodiments of the puzzle shown in FIGS. 1 and 4 and even FIG. 5 are relatively simple, although FIG. 5 is more complex than FIG. 1, but are for illustration. It should be understood that the visual representation can be very complex both in the actual image, similar to conventional two-dimensional puzzles, and in the particular manner in which it is applied to the spin elements, including obscuring of the dividing lines between the elements.

Figure 6:
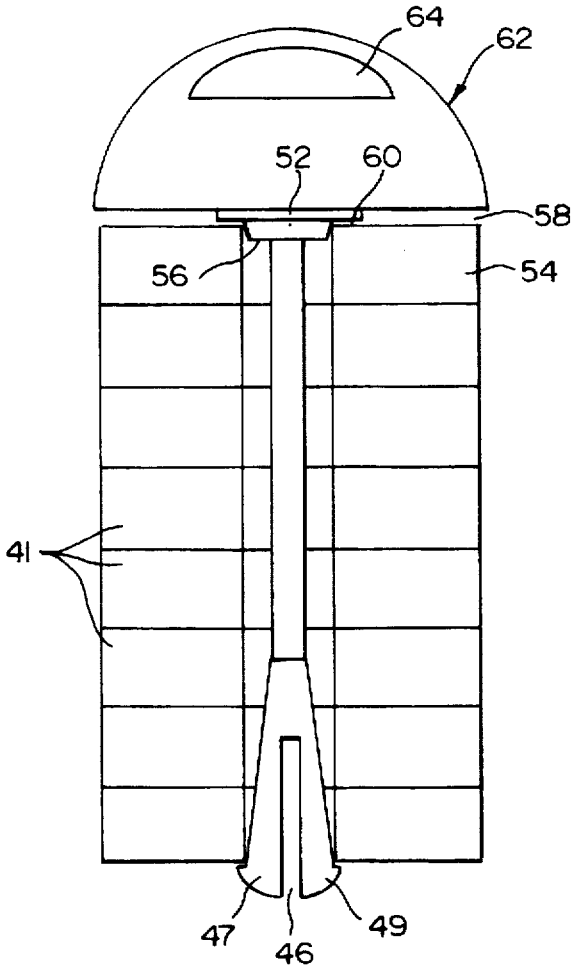
FIGS. 6 and 7 are elevational views of a spindle which can be used with a plurality of spin elements.
Figure 7:
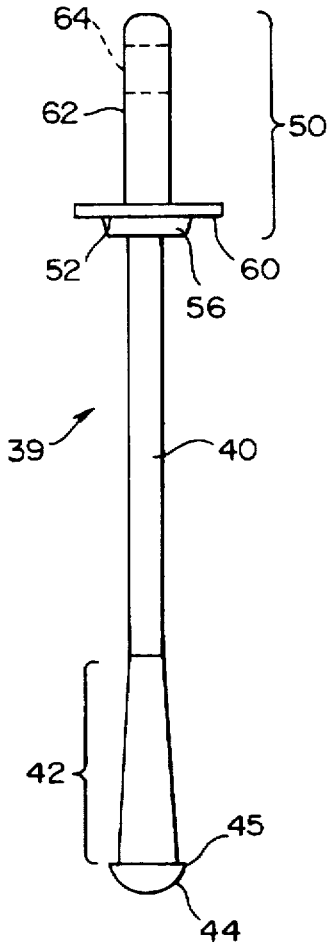

FIGS. 6 and 7 show a spindle arrangement which can be used with the spin elements described above. The combination of the spin elements and a spindle 39 could form a puzzle such as described above, or they could be used for word or number games and the like. Also, while the individual spin elements could be magnetic as described above, it is possible that the spin elements could be non-magnetic as well, so that they would not attract each other, although they could include means such as protuberances and corresponding cavities to provide an interlocking capability for the spin elements.

The spindle 39 includes an elongated rod-like mounting section 40 on which a plurality of spin elements 41 are arranged in consecutive, side-by-side fashion. In the embodiment shown, mounting portion 40 is long enough to accommodate eight spin elements. However, it should be understood that mounting portion 40 may be changed in length to accommodate more or fewer spin elements.

Mounting portion 40 includes a lower part 42 which flares slightly outwardly from the remainder of mounting portion 40 so that the diameter thereof is approximately ½ inch at its broadest position. The diameter of the remainder of the mounting portion 40 is approximately 7/16 inch. Lower part 42 terminates in a free end 44 which is approximately hemispherical. Lower part 42 has a slot 46 cut therein, which divides the lower part into two sections, 47 and 49. The slot 46 extends from the free end 44 upwardly approximately four inches. The width of slot 46 is approximately 3/16 inch.

At the point where free end 44 meets lower part 42, there is a small lip 45 which extends outwardly from the surface of lower part 42. Free end 44 thus has a slightly larger diameter than lower part 42 at the point where free end 44 joins lower part 42. Slot 46 enables the user to selectively temporarily decrease the diameter of the free end 44. This is accomplished by the user placing pressure on the two sections 47, 49 of the lower part 42, moving them toward each other. When the pressure is released, the two sections will rebound to their original position.

At the other end of mounting portion 40 is a top or head portion 50. Head portion 50 includes a retaining member 52 against which the topmost spin element 54 in the plurality of spin elements 41 abuts. A portion 56 of retaining member 52 is configured to fit within the central opening of the spin elements, so that there is a slight frictional contact between portion 56 and the edge of the central opening of the spin elements, with the upper surface 58 of spin element 54 resting against a flat portion 60 of retaining member 52.

Extending upwardly from retaining member 52 is a relatively thin (approximately ⅛ inch thick) holder 62. Holder 62 is semicircular in outline, having a diameter approximately equal to the diameter of the spin elements. An opening 64 in the upper portion of holder 62 permits the entire unit to be conveniently placed on a rack or similar display device.

In use, the plurality of spin elements 41 is arranged on spindle 39. The lower part 42 maintains the spin elements 41 in position adjacent each other. When the spin elements are to be rearranged, either as a puzzle or a word or number game, the two sections 47, 49 of the lower part are squeezed together, permitting the desired number of spin elements to be removed. To replace the spin elements, the individual spin elements, in the desired order, are placed adjacent the free end 44 and gentle inward pressure is applied toward the top end of the spindle, which squeezes the two sections of the lower part together, permitting the spin elements to be moved back onto the spindle. When the spin elements are in their desired place on the spindle, the two sections, when released, rebound to their original position, such that the lip of the free end 44 extends slightly beyond the edge of the central opening in the spin elements 41, maintaining the spin elements in position on the spindle 39.

Although a preferred embodiment of the invention has been disclosed herein for illustration, it should be understood that various changes, modifications and substitutions may be incorporated in such embodiment without departing from the spirit of the invention, which is defined by the claims which follow.

What is claimed is:

1. A spinable puzzle, comprising:

a plurality of puzzle elements, each puzzle element having first and second opposing faces and a peripheral edge surface therebetween, wherein the puzzle elements are magnetized, such that a first face of one puzzle element is attracted to a second, opposing face of another puzzle element, said plurality of puzzle elements being thus alignable along a common linear axis, wherein each puzzle element is rotatable relative to every other puzzle element and is positionable along said linear axis relative to every other puzzle element; and a two-dimensional visual representation, wherein the visual representation is divided into successive strip portions and wherein said strip portions are, respectively, formed on the peripheral edge surfaces of the puzzle elements, wherein when the puzzle elements are in a correct linear order and a correct rotational position, the visual representation is presented around the circumference and linearly of the spinable puzzle, wherein the visual representation is formed on the puzzle elements such that the visual representation is continuous and integrated around the peripheral surface of the spinable puzzle and linearly of the spinable puzzle, including linearly between first and last elements, the visual representation having no recognizable beginning or end, either peripherally or linearly between the puzzle elements.

2. An apparatus of claim 1, wherein the visual representation is similar to a conventional two-dimensional puzzle, around the peripheral surface of the spinable puzzle.

3. An apparatus of claim 1, wherein each puzzle element includes a series of protuberances on one of said first and second surfaces and a series of cavities on the other surface for receiving protuberances on an adjacent puzzle element, thereby facilitating the rotation of the puzzle elements relative to each other.

4. An apparatus of claim 3, including at least 15 protuberances spaced in a circle on the one surface about a center axis of the puzzle element and an equal number of cavities on the other surface.

5. An apparatus of claim 1, wherein each of the strip portions are substantially the same size and configuration, and wherein each strip portion has opposing ends which abut each other when the strip portion is positioned around the peripheral edge surface.

6. An apparatus of claim 1, wherein the visual representation is selected from the group consisting of (1) objects, (2) a geographical scene, (3) people, (4) animals or (5) plants.

7. An apparatus of claim 1, wherein the puzzle comprises at least eight puzzle elements.

* * * * *